US009103089B2

(12) United States Patent
Ogorchock et al.

(10) Patent No.: US 9,103,089 B2
(45) Date of Patent: Aug. 11, 2015

(54) LOOP AND SADDLE CONNECTION SYSTEM AND METHOD FOR MECHANICALLY STABLIZED EARTH WALL

(71) Applicants: John M. Ogorchock, Montgomery, TX (US); Guy C. Nelson, Byron Center, MI (US)

(72) Inventors: John M. Ogorchock, Montgomery, TX (US); Guy C. Nelson, Byron Center, MI (US)

(73) Assignee: Tricon Precast, Ltd., Houston, TX (US)

( * ) Notice: Subject to any disclaimer, the term of this patent is extended or adjusted under 35 U.S.C. 154(b) by 0 days.

(21) Appl. No.: 13/838,514

(22) Filed: Mar. 15, 2013

(65) Prior Publication Data

US 2014/0270991 A1 Sep. 18, 2014

(51) Int. Cl.
*E02D 29/02* (2006.01)

(52) U.S. Cl.
CPC ..... *E02D 29/0266* (2013.01); *E02D 29/0233* (2013.01)

(58) Field of Classification Search
CPC . E02D 29/02; E02D 29/0225; E02D 29/0233; E02D 29/0241
USPC ..... 405/262, 284, 285, 286
See application file for complete search history.

(56) References Cited

U.S. PATENT DOCUMENTS

| | | | | |
|---|---|---|---|---|
| 4,514,113 | A * | 4/1985 | Neumann | 405/286 |
| 5,707,184 | A * | 1/1998 | Anderson et al. | 405/286 |
| 5,797,706 | A * | 8/1998 | Segrestin et al. | 405/262 |
| 5,807,030 | A * | 9/1998 | Anderson et al. | 405/262 |
| 5,839,855 | A * | 11/1998 | Anderson et al. | 405/262 |
| 6,113,316 | A * | 9/2000 | Ash | 405/262 |
| 6,224,295 | B1 * | 5/2001 | Price et al. | 405/262 |
| 6,447,211 | B1 * | 9/2002 | Scales et al. | 405/262 |
| 6,447,212 | B2 * | 9/2002 | Orsat | 405/262 |
| 6,468,004 | B1 * | 10/2002 | Price | 405/262 |
| 2013/0136544 | A1 * | 5/2013 | McKittrick | 405/262 |

* cited by examiner

*Primary Examiner* — Frederick L Lagman
(74) *Attorney, Agent, or Firm* — Polasek, Quisenberry & Errington, LLP

(57) ABSTRACT

A loop and saddle assembly includes a loop member and a saddle member. The loop member may include multiple layers (preferably 4 layers) of a geosynthetic material. The saddle member may have a curved seating surface adapted for cooperative engagement with the inner surface of the loop member. The saddle member may include a first generally planar truncated end at a first end of the curved seating surface and a second generally planar truncated end at a second end of the curved seating surface. The saddle member may include a lower surface with a concave profile extending from the first truncated end to the second truncated end. The loop member may be cast into a precast concrete panel with a portion of the loop member extending out of the precast concrete panel. The saddle member may be disposed in cooperate engagement with the loop member inside the loop member.

10 Claims, 5 Drawing Sheets

LOOP AND SADDLE CONNECTION SYSTEM AND METHOD FOR MECHANICALLY STABLIZED EARTH WALL

BACKGROUND OF THE INVENTION

1. Field of the Invention

The present invention generally pertains to retaining walls for use in the road construction industry, and more particularly to improved connection systems and related methods for use with mechanically stabilized earth walls.

2. Description of the Related Art

It is known within a variety of fields to construct retaining walls for various purposes. Within the road construction industry, for example, it is known to erect temporary and permanent retaining walls for embankments, roadway supports, bridge abutments and the like. It is also known that these retaining walls can be constructed using a variety of techniques and materials, including, for example, concrete and/or welded wire components. An example of a precast modular wall panel is disclosed in U.S. Pat. No. 5,259,704 to Ogorchock. Examples of retaining walls constructed using welded wire components may be found in a number of U.S. patents, including, for example, U.S. Pat. No. 4,117,686 to Hilfiker, U.S. Pat. No. 4,329,089 to Hilfiker et al., U.S. Pat. No. 4,391,557 to Hilfiker et al., U.S. Pat. No. 4,505,621 to Hilfiker et al., U.S. Pat. No. 4,856,939 to Hilfiker, and U.S. Pat. No. 5,722,799 to Hilfiker.

In the above-listed patents, the precast concrete panels, which are used to form earth walls, are mechanically-stabilized by the use of welded wire grids or steel mesh soil mats. Instead of these metallic grids, however, another approach to stabilizing precast concrete panels has developed in which geosynthetic reinforcement strips are secured to the precast concrete panels and then anchored to the earth some distance away from the precast concrete panels. The present disclosure is generally directed to a novel way to secure the geosynthetic reinforcement strips to the precast concrete panels through the use, for example, of a plurality of loop and saddle members. As will become apparent from the following description and discussion, however, the present disclosure sets forth improved connection systems and related methods in comparison to those disclosed in the above-listed disclosures.

SUMMARY OF THE INVENTION

A loop and saddle connection system and methods for use in connection with the construction of earth walls is disclosed. In one aspect, the present invention may be a loop and saddle assembly for engagement with a precast concrete panel comprising: a loop member comprising multiple layers of a geosynthetic material, the loop member including an inner surface having a loop radius; and a saddle member having a curved seating surface adapted for cooperative engagement with the inner surface of the loop member, the saddle member further including a first generally planar truncated end at a first end of the curved seating surface and a second generally planar truncated end at a second end of the curved seating surface, the first and second generally planar truncated ends being disposed opposite one another, and the saddle member further including a lower surface extending from the first generally planar truncated end to the second generally planar truncated end. Another feature of this aspect of the invention may be that the lower surface of the saddle member may include a concave profile. Another feature of this aspect of the invention may be that the curved seating surface of the saddle member may include a saddle radius substantially equal to the loop radius. Another feature of this aspect of the invention may be that the curved seating surface of the saddle member may be recessed and include a first side wall and a second side wall, the curved seating surface being defined between the first and second side walls. Another feature of this aspect of the invention may be that the first side wall and second side wall may be spaced apart by a distance slightly greater than a width of the loop member. Another feature of this aspect of the invention may be that the loop member and saddle member may be sized such that the loop member snugly fits within the recess between the first and second side walls.

In another specific aspect, the present invention may be a loop and saddle assembly for engagement with a precast concrete panel comprising: a loop member comprising multiple layers of a geosynthetic material, the loop member including an inner surface having a loop radius; and a saddle member having a curved seating surface adapted for cooperative engagement with the inner surface of the loop member, the curved seating surface having a saddle radius substantially equal to the loop radius, the curved seating surface being recessed and including a first side wall and a second side wall, the curved seating surface being defined between the first and second side walls, the saddle member further including a first generally planar truncated end at a first end of the curved seating surface and a second generally planar truncated end at a second end of the curved seating surface, the first and second generally planar truncated ends being disposed opposite one another, the saddle member further including a lower surface extending from the first generally planar truncated end to the second generally planar truncated end, the lower surface having a concave profile. Another feature of this aspect of the invention may be that the first side wall and second side wall may be spaced apart by a distance slightly greater than a width of the loop member. Another feature of this aspect of the invention may be that the loop member and saddle member may be sized such that the loop member snugly fits within the recess between the first and second side walls.

In yet another aspect, the present invention may be an earth wall comprising: at least one precast concrete panel; a loop member partially cast in the at least one precast concrete panel, the loop member comprising multiple layers of a geosynthetic material and having an inner surface having a loop radius; a saddle member having a curved seating surface disposed in cooperative engagement with the inner surface of the loop member between the inner surface of the loop member and the at least one precast concrete panel, the saddle member further including a first generally planar truncated end at a first end of the curved seating surface and a second generally planar truncated end at a second end of the curved seating surface, the first and second generally planar truncated ends being disposed opposite one another, and the saddle member further including a lower surface extending from the first generally planar truncated end to the second generally planar truncated end; and a strip of geosyntheic material disposed in contact with the lower surface of the saddle member and secured to a section of earth spaced apart from the at least one precast concrete panel so as to impart a pulling force away from the at least one precast concrete panel.

Other features, aspects and advantages of the present invention will become apparent from the following discussion and detailed description.

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

DETAILED DESCRIPTION OF THE INVENTION

Figure 1:
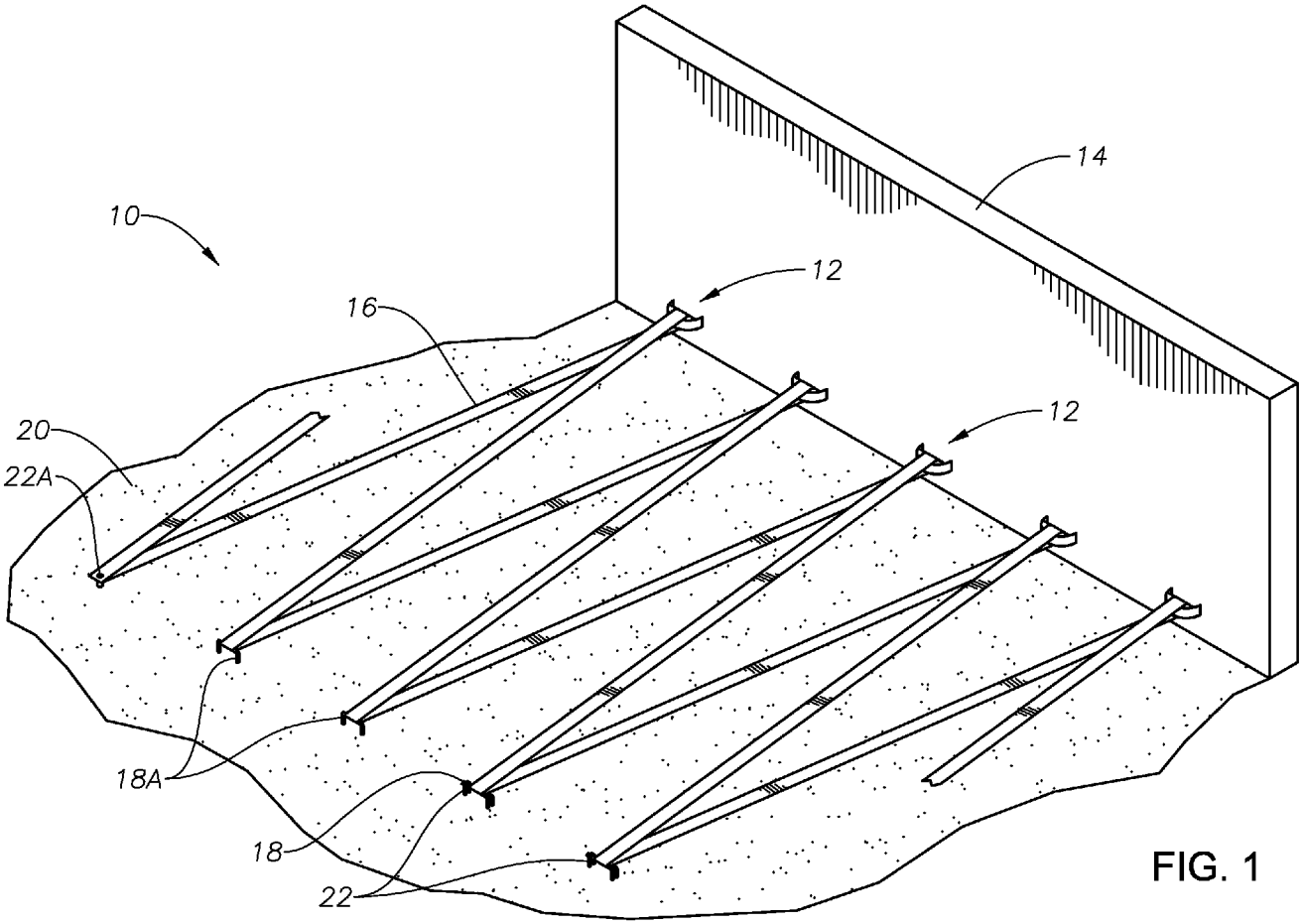
FIG. 1 is a perspective view of a mechanically stabilized earth wall employing a connection system as disclosed and discussed hereinbelow.

Referring to the drawings in detail, wherein like numerals denote identical elements throughout the several views, and referring initially to FIG. 1, there is shown a specific embodiment of a connection system 10 for a mechanically stabilized earth wall. In a specific embodiment, the connection system 10 may include a plurality of loop and saddle assemblies 12 attached to a precast concrete panel 14 used to form an earth wall. FIG. 1 illustrates the earth wall in the process of being constructed. The completed earth wall will include a plurality of concrete panels 14, as shown, for example, in U.S. Pat. No. 5,259,704 to Ogorchock (see panels 30).

The loop and saddle assemblies 12 are adapted to secure a geosynthetic reinforcement strip or web 16 to the concrete panel 14. The geosynthetic strip 16 may be of the type known as ParaWeb™ manufactured by Linear Composites Ltd, now owned by Officine Maccaferri S.p.a. The geosynthetic strip 16 is installed by threading an end of the strip 16 through one of the loop and saddle assemblies 12 and then back out some distance away from the panel 14 where it either terminates and is secured to the earth 20 with a securing member or stake 22A, or continues and is threaded through or around an anchor member 18 or 18A and then back toward the panel 14. The strip 16 is then threaded through successive loop and saddle assemblies 16 and anchor members 18 in a zig-zag pattern as illustrated in FIG. 1. In those situations where the strip 16 terminates and is secured to the earth with a securing member or stake 22A, the next section of the strip 16 originates at the same terminating location and is secured to the earth 20 with the same securing member or stake 22A. The strip is then threaded around the next loop and saddle assembly 12 and pulled back to the next securing member or stake.

Figure 2:
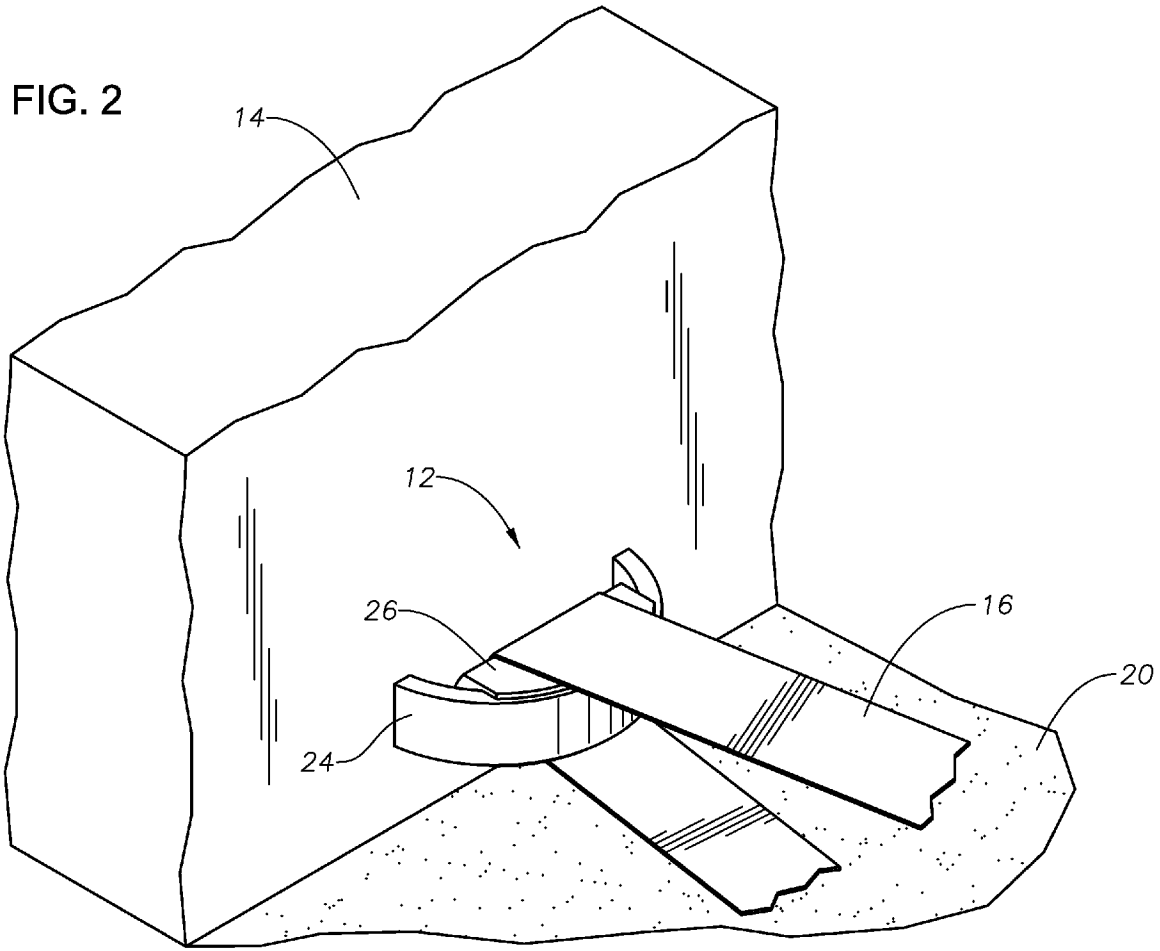
FIG. 2 is an enlarged perspective view of a portion of FIG. 1 and illustrates a loop and saddle assembly embedded in a precast concrete panel and engaged with a geosynthetic reinforcement strip.

With reference to FIG. 2, it can be seen that each loop and saddle assembly 12 includes a loop member 24 and a saddle member 26. The saddle member 26 is further illustrated in FIGS. 3 and 4, and the loop member is further illustrated in FIG. 5. With reference to FIG. 5, it is seen that in a specific embodiment the loop member 24 may include an inner surface 25 and comprise or be constructed from four layers or wraps of a geosynthetic material, such as the type known as FASTEN™ and made by Infrageo Co., Ltd., of Seoul, South Korea.

Figure 3:
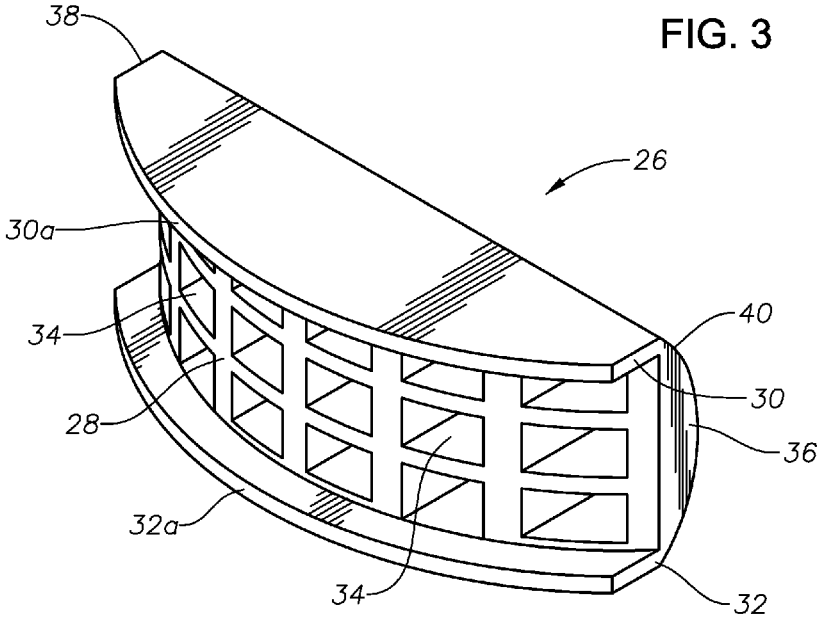
FIG. 3 is a perspective view of a saddle member that forms part of the loop and saddle assembly shown in FIGS. 1 and 2.
Figure 4:
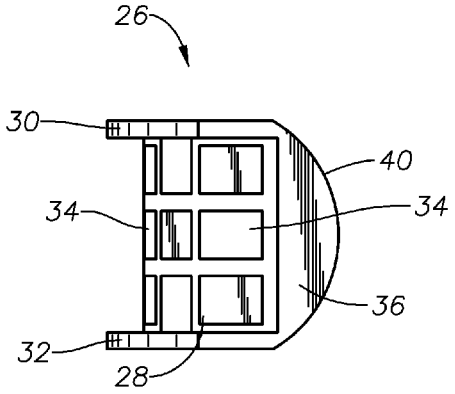
FIG. 4 is an end view of the saddle member shown in FIG. 3.
Figure 5:
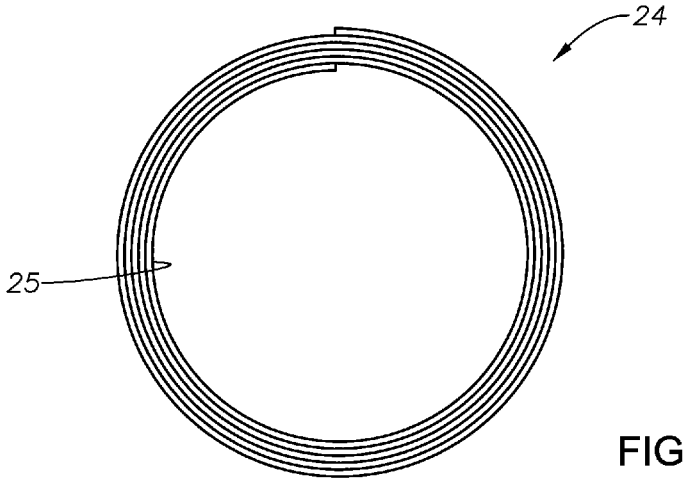
FIG. 5 is a side view of a loop member that forms part of the loop and saddle assembly shown in FIGS. 1 and 2.

Referring to FIGS. 3 and 4, in a specific embodiment the saddle member 26 may include a curved seating surface 28 adapted for cooperative engagement with the inner surface 25 of the loop member 24. In a specific embodiment, the curved seating surface 28 of the saddle member 26 may have a radius substantially the same as a radius of the inner surface 25 of the loop member 24. In a specific embodiment, as shown in FIGS. 3 and 4, the curved seating surface 28 of the saddle member 26 may be recessed and disposed transversely between first and second opposed sidewalls 30 and 32, each having an upper curved surface 30*a* and 32*a*, respectively, generally corresponding to the curvature of the curved seating surface 28. In a specific embodiment, the opposed first and second sidewalls 30 and 32 are spaced apart by a distance slightly greater than the width of the loop member 24 so as to snugly fit therearound. Stated differently, the loop member 24 and the saddle member 26 are preferably sized such that the loop member 24 snugly fits within the recess between sidewalls 30 and 32 so as to cooperatively engage with the saddle member 26. In a specific embodiment, the saddle member 26 may be constructed from High Density Polyethylene (HDPE) material. In a specific embodiment, the saddle member 26 may include a plurality of recessed indentations 34 extending downwardly from the curved seating surface 28 into the body of the saddle member 26. In a specific embodiment, the indentations 34 may be provided to facilitate manufacture of the saddle member 26 by injection molding.

The saddle member 26 may also include a first generally planar truncated end 36 and a second generally planar truncated end 38 disposed on opposite ends of the saddle member 26. The curved seating surface 28 may extend from the first truncated end 36 to the second truncated end 38. The saddle member 26 may also include a lower surface 40 extending from the first truncated end 36 to the second truncated end 38. In a specific embodiment, as shown for example in FIG. 4, the lower surface 40 may be provided with a rounded or concave profile. As seen for example in FIG. 6, the geosynthetic strip 16 is positioned around the concave profile of the lower surface 40 and pulls against the concave profile to hold the saddle member 26 in engaging relationship with the loop member 24.

The design of the saddle member 26 as shown in the Figures was developed after testing of various designs to determine the design of a saddle member that would withstand a desirable load rating. For example, as shown in the test reports attached as Appendix A (test results for saddle member shown in Figures), Appendix B (test results for inferior designs) and Appendix C (test results with no saddle member but loop only), it can be seen that the saddle member 26 shown in the Figures exhibited a higher load rating in comparison to inferior design for "saddle member" having legs embedded in the concrete panel and to use of the loop only.

Figure 6:
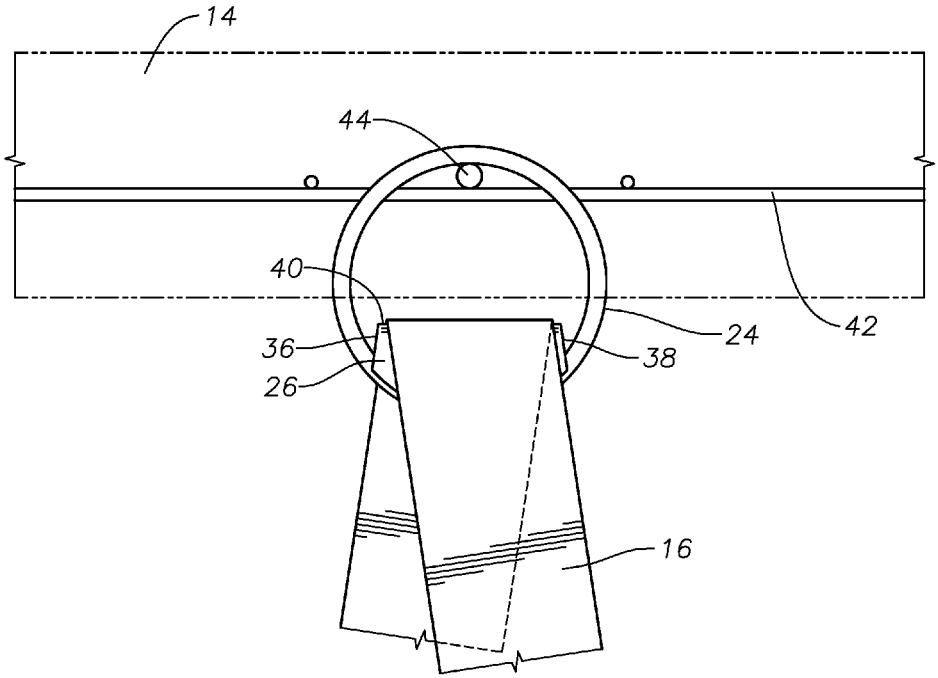
FIG. 6 is a top partial-sectional view of a loop and saddle assembly shown cast into a precast concrete panel and engaged to a welded-wire reinforcement grid member cast within the precast concrete panel.
Figure 7:
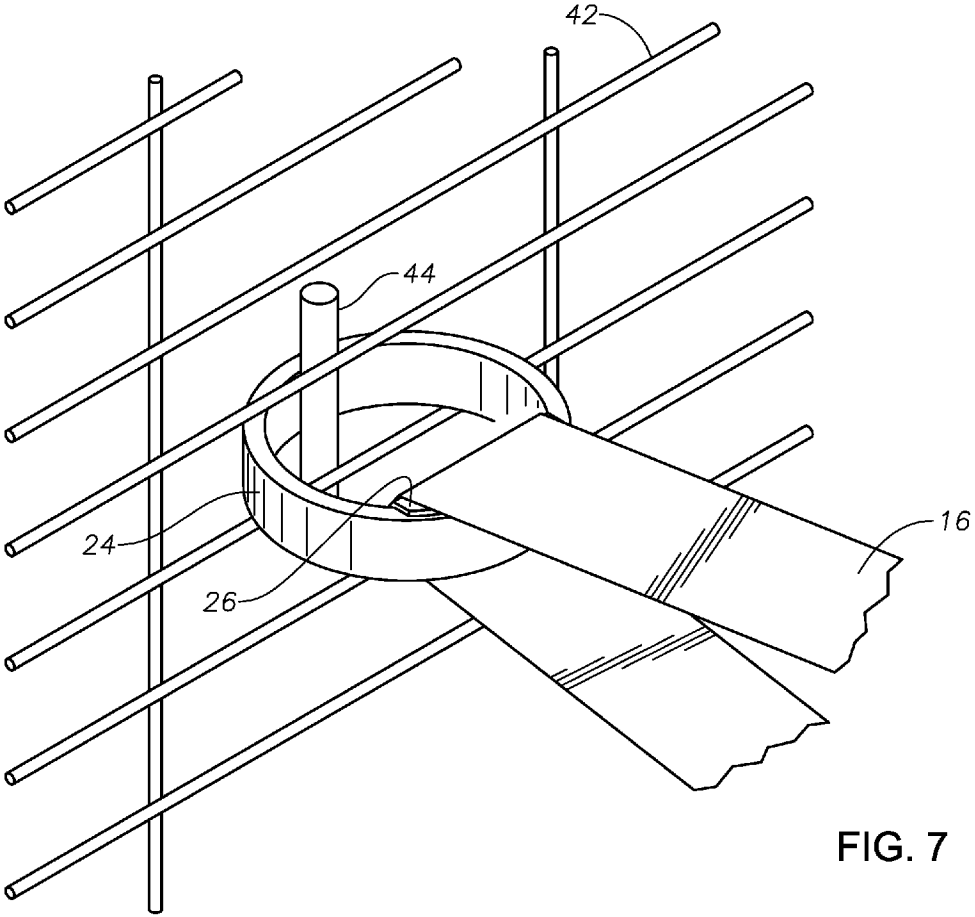
FIG. 7 is a perspective view of the details shown in FIG. 6 except it does not show the precast concrete panel.

Referring now to FIG. 6, there is shown a top view, partially sectioned, illustrating the manner in which the loop member 24 is cast in the precast concrete panel 14 with a portion of the loop member 24 extending out of a front face of the precast concrete panel 14. FIG. 6 further illustrates that a reinforcing cage member 42 (see also FIG. 7) is cast in the precast concrete panel 14 to provide reinforcement thereto. It can also be seen from FIG. 6 the manner in which a reinforcing member 44 is cast in the panel 14 and disposed through the loop member 24 and behind the grid member 42 so as to impart greater pull resistance to the loop member 24. FIG. 6 also shows that a sufficient portion of the loop member 24 should extend out of the concrete panel 14 so that, when the saddle member 26 is engaged with the loop member 24, the lower surface 40 of the saddle member 26 is spaced apart from the concrete panel 14 so as to form a space through which the geosynthetic strip 16 may be threaded.

It is to be understood that the invention is not limited to the exact details of construction, operation, exact materials or embodiments shown and described, as obvious modifications and equivalents will be apparent to one skilled in the art. It is further noted that the phrases downwardly and upwardly have been used herein for purposes of providing a frame of reference only; those phrases should not be taken as limitations. Accordingly, the invention is therefore to be limited only by the scope of the appended claims.

The invention claimed is:

1. A loop and saddle assembly for engagement with a precast concrete panel comprising:

a loop member comprising multiple layers of a geosynthetic material, the loop member including an inner surface having a loop radius; and a saddle member having a curved seating surface adapted for cooperative engagement with the inner surface of the loop member, the saddle member further including a first generally planar truncated end at a first end of the curved seating surface and a second generally planar truncated end at a second end of the curved seating surface, the first and second generally planar truncated ends being disposed opposite one another, and the saddle member further including a lower surface extending from the first generally planar truncated end to the second generally planar truncated end.

2. The loop and saddle assembly of claim 1, wherein the lower surface of the saddle member includes a concave profile.

3. The loop and saddle assembly of claim 1, wherein the curved seating surface of the saddle member has a saddle radius substantially equal to the loop radius.

4. The loop and saddle assembly of claim 1, wherein the curved seating surface of the saddle member is recessed and includes a first side wall and a second side wall, the curved seating surface being defined between the first and second side walls.

5. The loop and saddle assembly of claim 4, wherein the first side wall and second side wall are spaced apart by a distance slightly greater than a width of the loop member.

6. The loop and saddle assembly of claim 4, wherein the loop member and saddle member are sized such that the loop member snugly fits within the recess between the first and second side walls.

7. A loop and saddle assembly for engagement with a precast concrete panel comprising:

a loop member comprising multiple layers of a geosynthetic material, the loop member including an inner surface having a loop radius; and a saddle member having a curved seating surface adapted for cooperative engagement with the inner surface of the loop member, the curved seating surface having a saddle radius substantially equal to the loop radius, the curved seating surface being recessed and including a first side wall and a second side wall, the curved seating surface being defined between the first and second side walls, the saddle member further including a first generally planar truncated end at a first end of the curved seating surface and a second generally planar truncated end at a second end of the curved seating surface, the first and second generally planar truncated ends being disposed opposite one another, the saddle member further including a lower surface extending from the first generally planar truncated end to the second generally planar truncated end, the lower surface having a concave profile.

8. The loop and saddle assembly of claim 7, wherein the first side wall and second side wall are spaced apart by a distance slightly greater than a width of the loop member.

9. The loop and saddle assembly of claim 7, wherein the loop member and saddle member are sized such that the loop member snugly fits within the recess between the first and second side walls.

10. An earth wall comprising:

at least one precast concrete panel;

a loop member partially cast in the at least one precast concrete panel, the loop member comprising multiple layers of a geosynthetic material and having an inner surface having a loop radius;

a saddle member having a curved seating surface disposed in cooperative engagement with the inner surface of the loop member between the inner surface of the loop member and the at least one precast concrete panel, the saddle member further including a first generally planar truncated end at a first end of the curved seating surface and a second generally planar truncated end at a second end of the curved seating surface, the first and second generally planar truncated ends being disposed opposite one another, and the saddle member further including a lower surface extending from the first generally planar truncated end to the second generally planar truncated end; and a strip of geosynthetic material disposed in contact with the lower surface of the saddle member and secured to a section of earth spaced apart from the at least one precast concrete panel so as to impart a pulling force away from the at least one precast concrete panel.

* * * * *